US010119315B2

(12) United States Patent
Schneider

(10) Patent No.: US 10,119,315 B2
(45) Date of Patent: Nov. 6, 2018

(54) SLIDE AND SWING LEAF/SASH SYSTEM

(71) Applicant: SUNFLEX Aluminiumsysteme GmbH, Wenden (DE)

(72) Inventor: Malte Schneider, Wenden (DE)

(73) Assignee: SUNFLEX Aluminiumsysteme GmbH, Wenden (DE)

( * ) Notice: Subject to any disclaimer, the term of this patent is extended or adjusted under 35 U.S.C. 154(b) by 0 days.

(21) Appl. No.: 15/127,593

(22) PCT Filed: Jan. 11, 2016

(86) PCT No.: PCT/EP2016/050387
§ 371 (c)(1),
(2) Date: Sep. 20, 2016

(87) PCT Pub. No.: WO2016/113224
PCT Pub. Date: Jul. 21, 2016

(65) Prior Publication Data

US 2017/0130499 A1 May 11, 2017

(30) Foreign Application Priority Data

Jan. 16, 2015 (EP) ..... 15151501

(51) Int. Cl.
*E05D 15/58* (2006.01)

(52) U.S. Cl.
CPC ..... *E05D 15/58* (2013.01); *E05Y 2201/614* (2013.01); *E05Y 2201/638* (2013.01);
(Continued)

(58) Field of Classification Search
CPC .. E05D 15/58; E05D 15/0608; E05D 15/0665
See application file for complete search history.

(56) References Cited

U.S. PATENT DOCUMENTS 3,303,612 A * 2/1967 Baker ..... E05D 15/58 49/127
5,272,839 A * 12/1993 Karhu ..... E05D 15/58 16/95 R (Continued)

FOREIGN PATENT DOCUMENTS

DE 297 23 889 U1 5/1999
EP 1918495 A2 * 5/2008 ..... E05D 15/0604

(Continued)

OTHER PUBLICATIONS

International Search Report of PCT/EP2016/050387, dated May 4, 2016.

(Continued)

*Primary Examiner* — Catherine A Kelly
(74) *Attorney, Agent, or Firm* — Collard & Roe, P.C.

(57) ABSTRACT

A slide and swing leaf/sash system includes a floor rail profile and a ceiling rail profile which are each C-shaped and in which at least two leaves/sashes arranged therebetween are displaceably guided, which leaves/sashes are mounted at least in each case by at least one carriage in the floor rail profile in such a way that, in the swiveled-in state of the leaves/sashes, the weight load of the leaves/sashes is completely absorbed by the floor rail profile. At least one lateral outlet opening for releasing a leaf/sash is arranged in the floor rail profile, a lifting runner, which is arranged above the floor rail profile, being mounted on at least one leaf/sash, a ramp element being arranged on the floor rail adjacent to at least one outlet opening and interacting with the lifting runner in such a way that the leaf/sash is raised on passing the ramp element.

9 Claims, 6 Drawing Sheets

(52) U.S. Cl.
CPC ... *E05Y 2201/684* (2013.01); *E05Y 2900/132* (2013.01); *E05Y 2900/15* (2013.01)

(56) References Cited

U.S. PATENT DOCUMENTS 5,749,172 A * 5/1998 Isopahkala ..... E05D 15/0604 49/124
5,884,361 A * 3/1999 Richardson ..... E05D 15/0665 16/100
7,260,916 B2 * 8/2007 Sarnell ..... E04B 2/827 160/196.1
8,806,807 B2 * 8/2014 Rees ..... E05D 15/48 49/130
8,819,994 B2 * 9/2014 Ingram ..... E04B 2/827 49/125
8,978,302 B2 * 3/2015 Ona Gonzalez .... E05D 15/0608 49/125
2005/0011041 A1 * 1/2005 Ness ..... E05D 15/0669 16/105
2005/0284024 A1 * 12/2005 Bjorkman ..... E05D 15/58 49/176
2011/0094161 A1 4/2011 Rees
2014/0130417 A1 5/2014 Schneider et al.

FOREIGN PATENT DOCUMENTS

EP 2 546 441 A1 1/2013
WO 99/45224 A1 9/1999

OTHER PUBLICATIONS

European Search Report in EP 15151501.2, dated Jul. 16, 2016, with English translation of relevant parts.

* cited by examiner

SLIDE AND SWING LEAF/SASH SYSTEM

CROSS REFERENCE TO RELATED APPLICATIONS

This application is the National Stage of PCT/E22016/050387 filed on Jan. 11, 2016, which claims priority under 35 U.S.C. § 119 of European Application No. 15151501.2 filed on Jan. 16, 2015, the disclosure of which is incorporated by reference. The international application under PCT article 21(2) was not published in English.

BACKGROUND OF THE INVENTION

1. Field of the Invention

The invention relates to a slide-and-swing window panel system.

2. Description of the Related Art

Such slide-and-swing window panel systems are sufficiently known. They have multiple window panels, which can slide and be individually pivoted, thereby making it possible to almost completely open a generally very large front partition or room partition. The individual window panels are guided so as to slide on rail profiles disposed on the ceiling and the floor. In this regard, each window panel is displaceably guided in a ceiling rail profile, by way of two contact elements. To pivot a window panel, the ceiling rail profile has an outlet opening for releasing a contact element of a window panel. In this case, a spreader clamp is disposed in the ceiling rail profile, at the end, into which clamp a blocking element disposed on the respective window panel is introduced. To pivot a window panel, the blocking element is moved into the engagement cam element, and the contact element disposed at the other end of the window panel is released from the outlet opening and pivoted about the axis that runs through the blocking element. During this process, the blocking element rotates into a guide of the engagement cam element, so that the window panel is securely held.

It is a disadvantage of the previously known slide-and-swing window panel systems that the ceiling rail profile requires great carrying capacity of the ceiling on which it is mounted. This makes installation of the system on suspended ceilings, for example, difficult. In WO 99/45224 A1 a sliding window panel system is described, in which the window panels are displaceably mounted in the floor rail by way of a carriage, so that the weight force of the window panels is essentially absorbed by the floor rail. However, in this previously known system, it is not possible to release and pivot individual window panels.

SUMMARY OF THE INVENTION

This is where the invention wishes to create a remedy. The invention is based on the task of making available a slide-and-swing window panel system of the previously mentioned type, which allows installation even in the case of ceilings having limited carrying capacity. According to the invention, this task is accomplished by means of the characteristics described herein.

With the invention, a sliding window panel system of the previously mentioned type is created, in which installation is made possible even in the case of ceilings having only limited carrying capacity. Because of the fact that the at least two window panels are each mounted in the floor rail profile by way of at least one carriage, in such a manner that in the pivoted-in state of the window panels, i.e. flush with the floor and ceiling rail profile, complete absorption of the weight load of the window panels by the floor rail profile takes place, the ceiling rail profile serves merely for guiding the window panels disposed between floor rail profile and ceiling rail profile; the tensile stress on the ceiling rail profile is thereby clearly reduced or actually eliminated. In this regard, the at least one lateral outlet opening allows a window panel to be released and pivoted. Because of the interaction of lifting runner and ramp element, the window panel with the lifting runner disposed on it is lifted as it passes the ramp element. In this way, the rollers are relieved of stress. When the parked position is reached, i.e. the pivoted-out position of the window panel, the rollers are without contact with the floor rail and therefore can be moved out of the outlet opening, together with the window panel.

It is advantageous if an engagement cam element is disposed at least in the ceiling rail profile, at the end, to accommodate a blocking element disposed on each window panel, wherein at least one outlet opening for releasing a window panel is disposed in the floor rail profile, at a horizontal distance from the engagement cam element. In addition, an engagement cam element can also be provided in the floor profile, wherein in this case, a corresponding blocking element is required, preferably on the carriage.

Preferably, the window panels are provided with at least one guide cylinder on their top, facing the ceiling rail profile, which cylinder projects into the gap of the C-shaped ceiling rail profile. In this way, the window panel is guided in the gap of the ceiling rail profile by way of the guide cylinder, without a contact load acting on the ceiling rail profile. It is advantageous if the blocking element is attached to the guide cylinder, particularly formed onto it or screwed onto it.

In a further development of the invention, the lifting runner is disposed on the carriage. In this way, a compact construction is achieved.

In an embodiment of the invention, at least one outlet opening is framed by a guide frame, on which the ramp element is formed. In this way, combined lifting and guidance of a window panel to pivot it out is made possible.

It is advantageous if the ramp element is configured so that it can be lifted out of the travel path of the lifting runner. In this way, displacement of a window panel without lifting it is made possible in the event that it is not supposed to be pivoted.

In a further embodiment of the invention, a hold-down mechanism is disposed on at least one window panel. Preferably, the hold-down mechanism is disposed on the carriage, particularly below a wheel of the carriage, in such a manner that the gap of the floor rails runs between wheel and hold-down mechanism. In this way, a further compact construction is achieved.

In a further embodiment of the invention, the hold-down mechanism interacts with the floor rail in such a manner that linear guidance of the related window panel is brought about. In this way, guided movement of the window panel along the floor rail is achieved.

In a further development of the invention, the carriage comprises a carriage housing having a window panel accommodation and a hollow-cylindrical bearing accommodation formed onto the latter, in which bearing accommodation a bearing for rotatable mounting of an axle is disposed, which axle accommodates at least one wheel, wherein a hold-down mechanism is formed on the bearing accommodation, opposite to the window panel accommodation. In this regard, the lifting runner is formed on the carriage housing at a distance from the bearing accommodation.

BRIEF DESCRIPTION OF THE DRAWINGS

Other further developments and embodiments of the invention are indicated in the remaining dependent claims. An exemplary embodiment of the invention is shown in the drawings and will be described in detail below. The figures show:

DETAILED DESCRIPTION OF THE PREFERRED EMBODIMENTS

Figure 1:
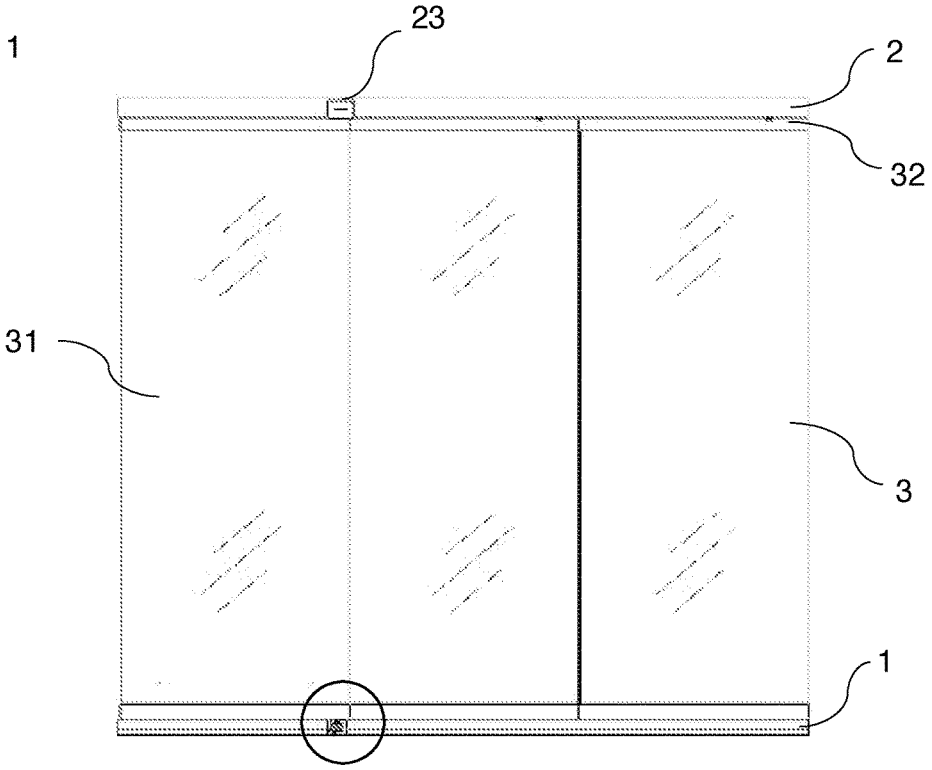
FIG. 1 the schematic representation of a slide-and-swing window panel system.
Figure 2:
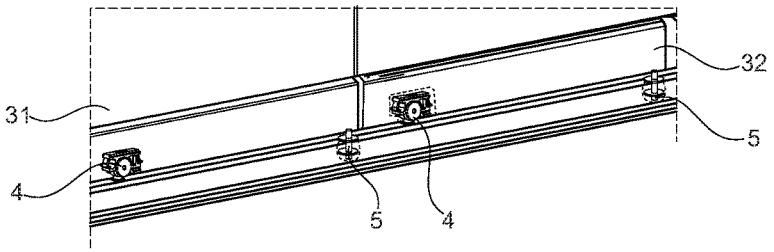
FIG. 2 the detail representation of the window panel guidance of the floor profile of the slide-and-swing window panel system from FIG. 1.
Figure 3:
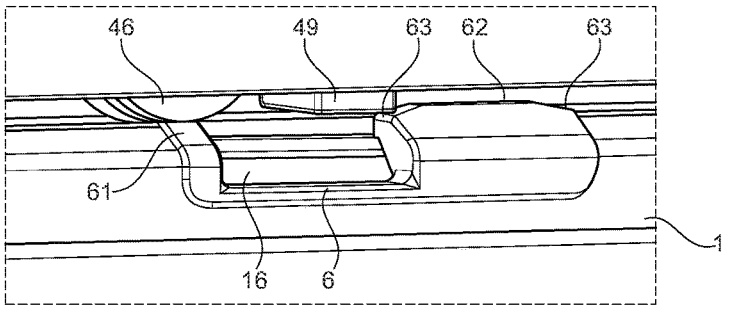
FIG. 3 the representation of the outlet opening of the slide-and-swing window panel system from FIG. 1.
Figure 4:
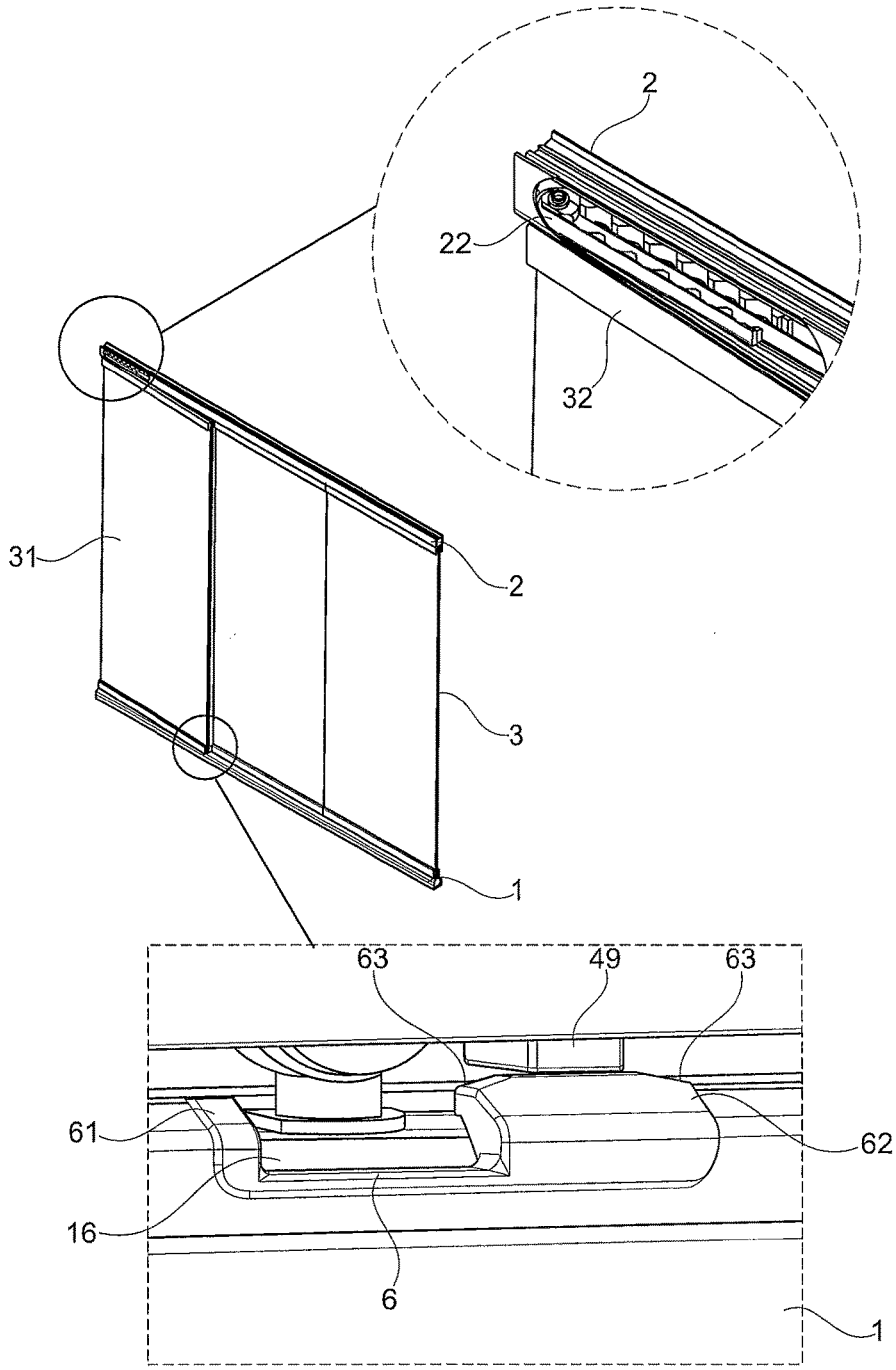
FIG. 4 the spatial representation of the slide-and-swing window panel system from FIG. 1 with partial details.
Figure 5:
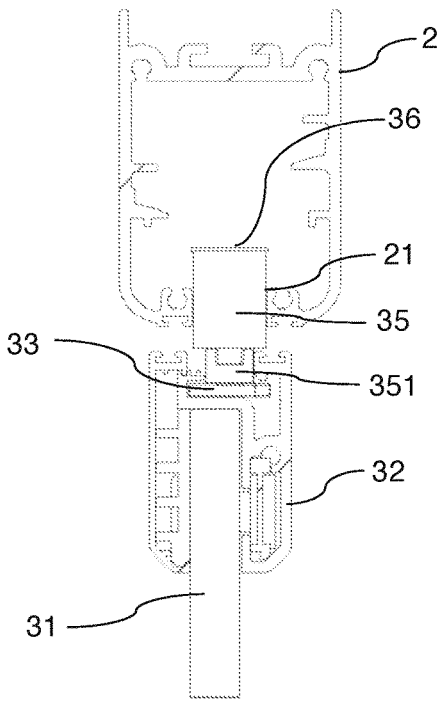
FIG. 5 the schematic representation of the engagement of the guide cylinder of a window panel into a ceiling rail profile, in cross-section.
Figure 6:
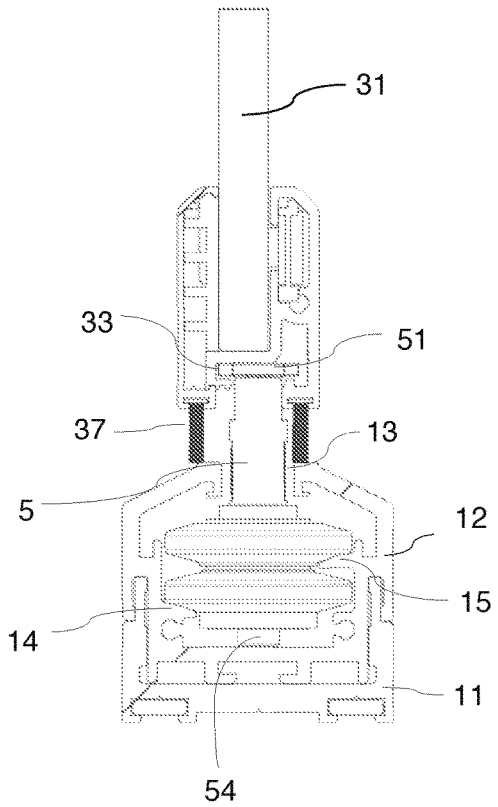
FIG. 6 the schematic representation of the arrangement of a carriage of a window panel in a floor rail profile, in cross-section.
Figure 7:
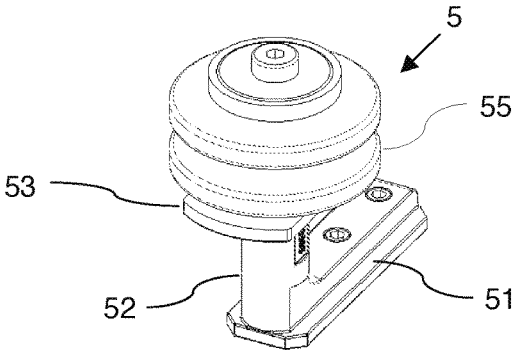
FIG. 7 the schematic representation of a carriage of a slide-and-swing window panel system in a further embodiment having horizontal wheels.
Figure 8:
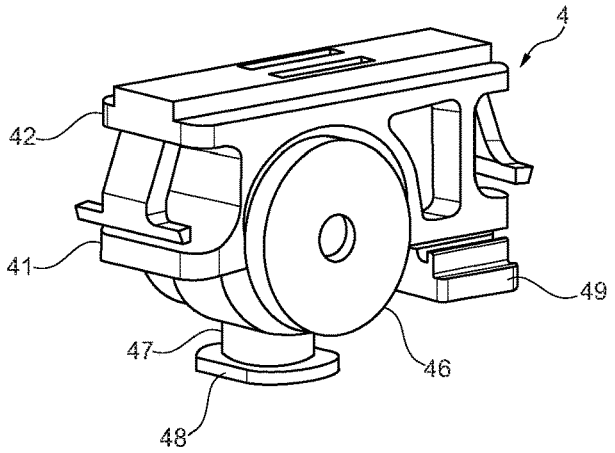
FIG. 8 the spatial representation of a first carriage of the slide-and-swing window panel system from FIG. 1.
Figure 9:
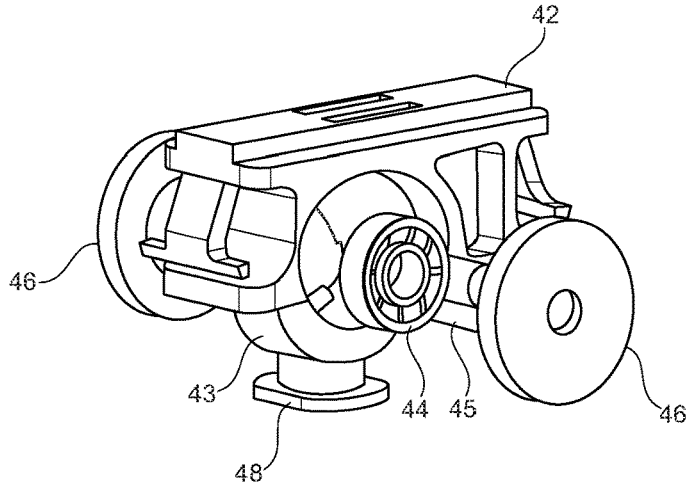
FIG. 9 the carriage from FIG. 8 with an integrated hold-down mechanism and lifting runner, in an exploded representation.
Figure 10:
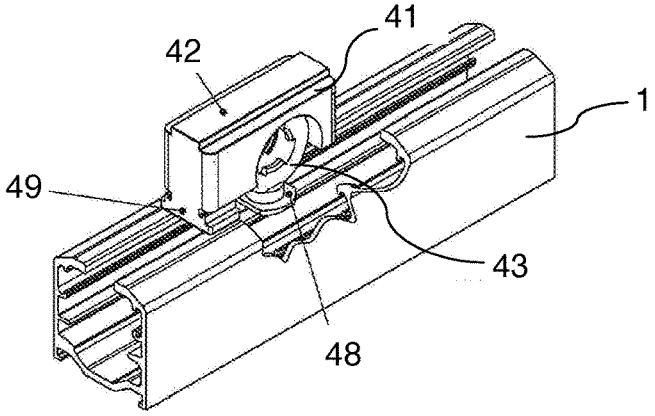
FIG. 10 the schematic representation of the carriage from FIG. 8 in engagement with a floor rail.

The slide-and-swing window-panel system selected as an exemplary embodiment consists essentially of a floor rail profile 1, a ceiling rail profile 2, as well as a number of window panels 3, which are displaceably guided in the floor rail profile 1 by way of carriages 4, 5. On the ceiling side, the window panels 3 are guided in the ceiling rail 2 profile by way of a guide cylinder 35.

The floor rail profile 1 is formed from a base profile 11 and a support profile 12 attached to it, which latter profile is attached in the base profile 11 in height-adjustable manner. The support profile 12 is essentially configured in the manner of a C-profile, and has a gap 13 on its top, which faces away from the base profile 11. Within the support profile 12, a first crosspiece 14 is formed on a longitudinal side wall, and, on the opposite longitudinal side wall, vertically offset from the first crosspiece 14, a second crosspiece 15 is formed on. Furthermore, an outlet opening 16 is introduced into the floor rail profile 1, in a longitudinal side wall. The outlet opening 16 of the floor rail profile 1 is framed by a guide frame 6, on the top of which, facing the window panels 3, a contact surface 61 is formed. On one side, a ramp element 62 is formed on the contact surface, which element is provided with a bevel 63 on both sides. In the exemplary embodiment, the guide frame 6 with the ramp element 62 formed on it is produced from plastic.

The ceiling rail profile 2 is configured essentially in the manner of a C-profile, and has a gap 21 on its top that lies opposite the floor rail profile 1. Laterally, an outlet opening 23 for releasing a guide cylinder 35 of a window panel 3 is affixed in the ceiling rail profile 2. (If only one guide cylinder 35 is disposed on the window panel 3, the ceiling rail profile does not have an outlet opening 23.) At the end, an engagement cam element 22 is disposed in the ceiling rail profile 2. The engagement cam element 22 is configured in the form of a pincer-shaped plastic part, having arms disposed to lie opposite one another, in which arms arc-shaped formations that follow one another are introduced, which formations are provided, approximately in the center, with a groove that runs transverse to the ceiling profile 2, to accommodate the blocking element 36 of a window panel 3. The inside contour of the arc-shaped formations essentially corresponds to the outside contour of the guide cylinder 35 of the window panel 3.

The window panels 3 are each formed from a pane element 31, which is framed at the ends with a frame profile 32. On their side that lies opposite the pane element 31, the frame profiles 32 are provided, in each instance, with a C-shaped accommodation 33 for accommodating the groove plate 42, 51 of a carriage 4, 5 or the groove plate 351 of a guide cylinder 35. In the exemplary embodiment, each window panel 3 is provided, on its side facing the ceiling rail profile 2, with two guide cylinders 35, and, on its side facing the floor rail profile 1, with two carriages 4, 5, which are attached in the C-profile-type accommodation 33 of the frame profile 32 by way of their groove plates 351, 42, 51, in each instance. The guide cylinder 35 of each window panel 3 that faces the engagement cam element 22, in each instance, is provided with a blocking element 36 on its top, which lies opposite the frame profile 32, which element is essentially configured in the manner of a rectangular plate having arc-shaped, narrow sides. On the underside of the guide cylinder, facing the floor rail profile 1, the window panels 3 are furthermore provided with brushes 37 on both sides.

The first carriage 4 comprises a carriage housing 41, on which a groove plate 42 is formed. The groove plate 42 serves as an accommodation for a window panel 3, in the frame profile 32 of which the groove plate 42 can be attached. In the carriage housing 41, an essentially hollow-cylindrical bearing accommodation 43 is disposed below the groove plate 42, which accommodation accommodates a roller bearing 44. The roller bearing 44 accommodates an axle 45, at the two ends of which a wheel 46 is attached, in each instance. The bearing accommodation 43 is followed by a cylindrical crosspiece 47, which makes a transition, at the end, into a hold-down mechanism 48 that projects on all sides. A lifting runner 49 is furthermore disposed on the carriage housing, at a distance from the bearing accommodation 43. The lifting runner 43 is configured in the manner of a punch. Its free end is positioned somewhat higher than the running surfaces of the wheels 46.

The second carriage 5 is positioned at the end of the frame profile 32 of a window panel 3 that lies opposite the first carriage 4. It has a groove plate 51 on which a support arm 52 is formed, orthogonal to the plate. An essentially rectangular plate 53 follows the support arm 52, which plate makes a transition into an axle 54 for accommodating two rollers 55, disposed parallel to one another.

The window panels 3 are disposed between floor rail profile 1 and ceiling rail profile 2 in such a manner that the support arm 52 of the second carriage 5, in each instance, projects through the gap 13 of the floor rail profile 1, wherein the roller 55 of the respective carriage 5, which roller faces the plate 53, in each instance, lies on the second crosspiece 15, and the second roller 55 lies on the first crosspiece 14 of the floor rail profile 1. As a result, the wheels run in opposite directions when a window panel is moved. The wheels 46 of the first carriage, in each instance, lie on the support profile 12 of the floor profile 1, at the top. In this regard, the crosspiece 47 also projects through the gap 13 of the floor rail profile 1, wherein the hold-down mechanism 48 lies against the support profile 12 on both sides of the gap 13, on the inside. On the side opposite the carriage, the guide cylinders 35 project into the ceiling rail profile 2 through the gap 21.

To pivot a window panel 3 of the slide-and-swing window panel system, the window panel 3 is first displaced along the floor rail profile 1 until the blocking element 36 engages into the free formation of the engagement of the engagement cam element 22. In this regard, the lifting runner 49 of the carriage 4 disposed at the opposite end of the window panel 3 is moved over the bevel 63 of the ramp element 62 assigned to an outlet opening 16, thereby lifting the wheels 46 of this carriage 4 vertically relative to the support profile 12. In this position, the carriage 4 is situated at the outlet opening 16 of the profile 1; the outer guide cylinder 35 is situated at the outlet opening 23 of the ceiling rail profile 2. (As has already been noted, no outlet opening 23 is present in the ceiling rail profile 2 if only one guide cylinder 35 is disposed on the window panel.)

If the window panel 3 is subsequently pivoted about the axis of rotation that runs through the blocking element 36, then the carriage 4 situated at the outlet opening 16, the wheels 46 of which are no longer in contact with the support profile 12, is released from the latter. In this regard, the lifting runner 49 slides on the ramp element 62, which forms an elevated contact surface, until the blocking element 36 engages into the groove of the engagement cam element 22, thereby causing the blocking element 36 to reach its holding point. Subsequently, the further window panels can be released accordingly and laid against the first window panel 3, by pivoting them.

Figure 11:
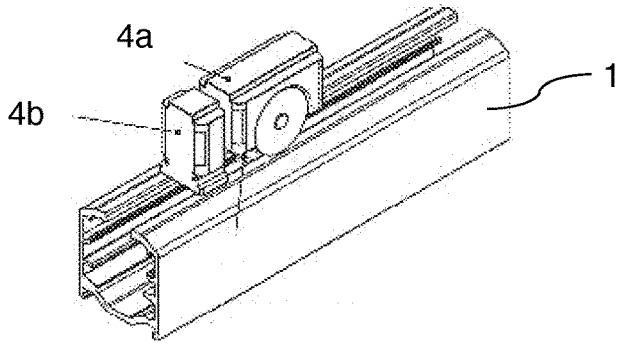
FIG. 11 the representation from FIG. 10 with a carriage in a second embodiment, with a separate lifting runner.
Figure 12:
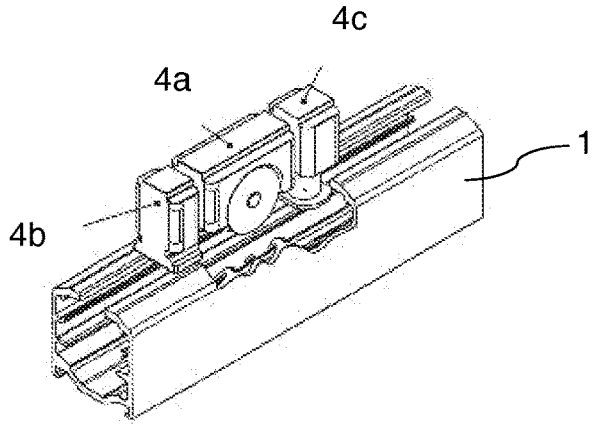
FIG. 12 the representation from FIG. 10 with a carriage in a third embodiment, with a separate lifting runner and hold-down mechanism.
Figure 13:
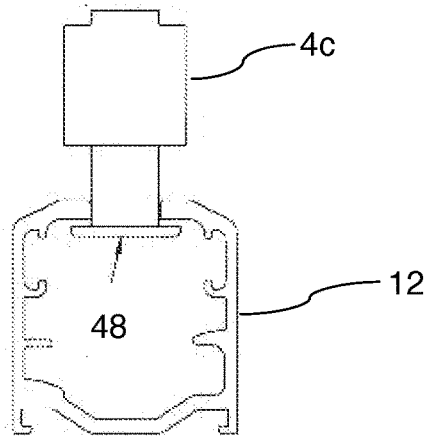
FIG. 13 the schematic representation of the hold-down mechanism of the carriage from FIG. 8 in engagement with a floor rail.
Figure 14:
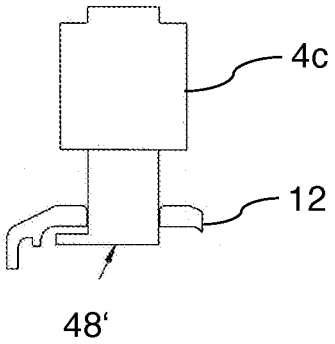
FIG. 14 the schematic, representation of a hold-down mechanism in a second embodiment, with a projection on one side, in engagement with a floor rail, and FIG. 15 the schematic representation of a hold-down mechanism in a third embodiment, with a U-shaped projection on one side, in engagement with a modified floor rail having a vertical guide crosspiece.
Figure 15:
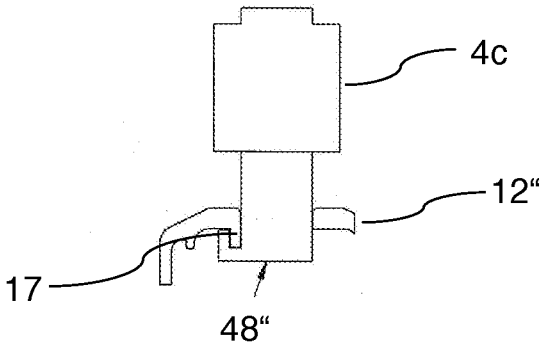

In the exemplary embodiment, the carriage 4 is structured with an integrated hold-down mechanism 48 and lifting runner 49. Of course, hold-down mechanism and/or lifting runner can also be an integral part of separate components that can be attached to the frame 32 of a window panel 3, as is shown, for example, in FIG. 11 (carriage 4*a* with lifting runner component 4*b*) and FIG. 12 (carriage 4*a* with lifting runner component 4*b* and hold-down mechanism component 4*c*). The hold-down mechanism can also be configured in different ways. For example, in FIG. 14 a hold-down mechanism 48' is shown, which projects merely on one side of the crosspiece 47, with which it lies against the floor profile 1 on the inside. In FIG. 15, in the case of the hold-down mechanism 48", this one-sided projection is configured in U-shape, and the modified support profile 12" of the floor profile 1 has a guide crosspiece that engages into the U-shaped projection.

The invention claimed is:

1. A slide-and-swing window panel system, comprising
- a floor rail profile configured in a C-shape and comprising
- a guide frame and a lateral outlet opening in the guide frame,
- a ceiling rail profile configured in a C-shape,
- a first window panel disposed between the floor rail profile and the ceiling rail profile and guided so as to slide,
- a second window panel disposed between the floor rail profile and the ceiling rail profile and guided so as to slide,
- a first carriage, the first window panel being mounted in the floor rail profile by way of the first carriage, in such a manner that in a pivoted-in state of the first window panel, a weight load of the first window panel is entirely absorbed by the floor rail profile,
- a second carriage, the second window panel being mounted in the floor rail profile by way of the second carriage, in such a manner that in a pivoted-in state of the second window panel, a weight load of the second window panel is entirely absorbed by the floor rail profile,
- a lifting runner affixed to the first window panel, the lifting runner being disposed above the floor rail profile, and
- a ramp element disposed on the floor rail profile, disposed adjacent to the lateral outlet opening, and being formed on the guide frame,
- wherein, as the lifting runner affixed to the first window panel passes the ramp element, the ramp element interacts with the lifting runner, and the lifting runner slides on the ramp element, in such a manner that the first window panel is lifted,
- wherein the lateral outlet opening is for releasing the first window panel.

2. The slide-and-swing window panel system according to claim 1, wherein the lifting runner is disposed on the first carriage.

3. The slide-and-swing window panel system according to claim 1, wherein a holding pad is disposed on the first window panel.

4. The slide-and-swing window panel system according to claim 3, wherein the holding pad is disposed on the first carriage.

5. The slide-and-swing window panel system according to claim 4, wherein the first carriage comprises a wheel,
- wherein the floor rail profile comprises a gap, and
- wherein the holding pad is disposed below the wheel of the first carriage, in such a manner that the gap of the floor rail profile runs between the wheel and the holding pad.

6. The slide-and-swing window panel system according to claim 3, wherein the holding pad interacts with the floor rail profile in such a manner that linear guidance of the first window panel is brought about.

7. The slide-and-swing window panel system according to claim 1, wherein the ramp element is configured to be moved out of a travel path of the lifting runner.

8. The slide-and-swing window panel system according to claim 1, wherein the first carriage comprises a carriage housing having a window panel accommodation and a hollow-cylindrical bearing accommodation formed on the window panel accommodation, wherein a bearing for rotatable mounting of an axle is disposed in the hollow-cylindrical bearing accommodation, wherein the axle accommodates at least one wheel, and wherein a holding pad is formed on the hollow-cylindrical bearing accommodation, opposite to the window panel accommodation.

9. The slide-and-swing window panel system according to claim 8, wherein the lifting runner is formed on the carriage housing at a distance from the hollow-cylindrical bearing accommodation.

* * * * *